United States Patent [19]

Meltzer

[11] 4,111,545

[45] Sep. 5, 1978

[54] VIBRATING BLADE CLEANER

[75] Inventor: David W. Meltzer, Miami, Fla.

[73] Assignee: Xerox Corporation, Stamford, Conn.

[21] Appl. No.: 547,522

[22] Filed: Feb. 6, 1975

[51] Int. Cl.[2] ..... G03G 21/00

[52] U.S. Cl. ..... 355/15; 15/256.53; 96/1 R

[58] Field of Search ..... 355/15, 17; 96/1 R; 15/256.51, 256.53, 1.5; 118/637; 427/444

[56] References Cited

U.S. PATENT DOCUMENTS

| | | | |
|---|---|---|---|
| 3,617,123 | 11/1971 | Emerson | 355/15 |
| 3,660,863 | 5/1972 | Gerbasi | 355/15 |
| 3,724,019 | 4/1973 | Shanly | 355/15 X |
| 3,740,789 | 6/1973 | Ticknor | 355/15 X |
| 3,847,480 | 11/1974 | Fisher | 355/15 |
| 3,859,691 | 1/1975 | Katayama et al. | 15/256.51 |
| 3,871,762 | 3/1975 | Van Der Vlasakker | 355/15 |

FOREIGN PATENT DOCUMENTS

| | | | |
|---|---|---|---|
| 973,766 | 10/1964 | United Kingdom | 15/256.53 |

*Primary Examiner*—Richard L. Moses

[57] ABSTRACT

A blade cleaning apparatus, process, and reproducing machine are provided for removing residual particulate material such as toner from the surface of an electrostatic imaging member. Improved cleaning particularly with respect to developer side seal failures is obtained by rapidly vibrating the blade during cleaning. Means can be provided for selectively activating the vibration of the blade so that vibration may be applied only after the imaging member is stopped or during movement of the imaging member and for a short time after it has stopped. In accordance with an alternate embodiment, the blade is vibrated so that the edge of the blade which contacts the surface of the imaging member has a vibrational velocity which is greater than the surface velocity of the imaging member.

28 Claims, 6 Drawing Figures

VIBRATING BLADE CLEANER

BACKGROUND OF THE INVENTION

This invention relates to electrostatographic imaging systems and more particularly to an improved blade cleaning apparatus for cleaning electrostatographic image developer material from an imaging surface.

One method for cleaning of electrostatographic plates is disclosed in U.S. Pat. No. 3,552,850, to Royka et al. A flexible cleaning blade is used in pressure contact at the photoconductive surface to remove residual toner particles. Royka et al. also disclose that a dry solid lubricant may be supplied to the electrostatographic plate.

It is also known to supply slow translation to the cleaning blade in an electrostatographic plate cleaning apparatus. Such translation systems are described in detail in U.S. Pat. Nos. 3,724,019 to Shanley; 3,724,020 to Till; 3,740,789 to Ticknor; 3,847,480 to Fisher; and 3,854,814 to Jones. The systems described in the Shanley, Till, and Ticknor patents are similar in many respects to those employed commercially in the Xerox 3100 and 4000 copiers. In those systems the blade is slowly moved parallel to the drum axis in a reciprocal fashion. One of the features of those systems is that the slow sideways translation of the blade distributes the wear caused by an individual drum asperity over a relative large portion of the blade edge. This consequently extends blade life and reduces the occurrence of cleaning failures. It has also been found that slow translation of the blade for a few seconds after the drum had stopped is beneficial in breaking up particle accumulation developed between the blade and the photoconductive surface, thereby providing improved cleaning.

Copiers employing blade cleaning systems can be subject to random cleaning failures which can result in undesirable print-out on the copy sheet. For example, "toner streaking" which can print-out can be caused by a local "tuck under" or folding under of the blade edge which allows the toner to pass under the blade. Lubricants are employed in the commercial copiers to reduce the occurrence of such tuck-unders. In one system a particulate lubricant is employed which forms a seal between the blade and the photoconductive surface to provide effective blade cleaning. It has been observed, however, that the toner build-up in front of the cleaning blade is not always a loose fluffy powder as might be expected. In fact, it frequently is a relatively solid closely packed mass. The solidity of the clean toner is especially evident when there has been a cleaning failure. It is possible that hard packed toner inhibits reliable lubrication and sealing of the blade, thereby increasing the liklihood of a cleaning failure.

Yet another type of cleaning failure which can occur in electrostatographic systems comprises a "developer side seal failure". In this instance toner is impacted on the drum surface ends through the action of the developer housing end seals against the drum surface. The impacted toner which build-up on the ends of the drum surface lies generally outside the imaging area. Normally the cleaning blade extends across the entire drum surface including the area of the side seal failure. However, if the side seal failure is not effectively cleaned by the cleaning system then the impacted toner can build-up and spread into the imaging area, and print-out on the resulting copy sheets.

It has been found that improved cleaning with a blade cleaning system can be obtained by rapidly vibrating the blade. This approach has been found to provide an improvement over the systems of Shanley and Till, particularly with respect to the elimination of side seal failures.

In U.S. Pat. No. 3,617,123 to Emerson, a method and apparatus for cleaning residual toner material is provided wherein a brush mounted at the entrance to a development-cleaning station is vibrated to uniformly distribute residual toner over the entire area of the photoconductive surface to improve cleaning. The brush itself does not remove the toner.

In addition to the foregoing patents, numerous patents exist in fields outside electrostatography, which deal with the use of reciprocating, oscillatory, or vibrating doctor blades. Exemplary of oscillatory systems are U.S. Pat. Nos. 2,300,908; 2,544,557; 2,857,612; 2,972,767; and 3,130,439. Exemplary of vibrating systems are U.S. Pat. Nos. 2,885,069; 3,087,184; 3,389,655; and 3,617,123. U.S. Pat. No. 3,087,184 in particular shows the use of a vibrating doctor blade mechanism to provide a self-cleaning action for the blade.

In blade cleaning of toner, the toner is not being doctored, rather the toner is preferably totally stopped by the cleaning blade or blades in a single rotation of the photoreceptor drum or surface, and simultaneously or subsequently removed from the surface. The entire surface must be cleaned thousands of times without damage. The cleaning loads on the blade are very uneven, both short term and long term, because the location, density and tenacity of the residual toner varies widely over the surface, depending on the images, the exposures, the surface charges, the toner development, the image border areas, etc. Furthermore, the frictional forces of the cleaning operation, unless carefully controlled, can easily result in the generation of excessive pressure or heat, resulting in physical and chemical changes in the toner, smearing of toner materials onto the photoreceptor, or blade, excessive photoreceptor wear, or other problems, especially in higher speed machines. Thus, cleaning dry toner from a photoreceptor presents extremely critical requirements not normally found in other cleaning fields, and blade cleaning systems suitable for other fields and applications, e.g., cleaning or doctoring systems for metal gravure rollers or inking rollers or paper mill rollers or adhesive applicators, are not normally appropriate.

SUMMARY OF THE INVENTION

This invention relates to a cleaning system for cleaning residual toner particles from the surface of an electrostatographic imaging member. The cleaning system includes at least one blade-like element having a cleaning edge adapted to bear against the surface of the imaging member. The blade extends completely across the imaging surface. Means are provided for rapidly vibrating the blade in a direction parallel to the imaging surface. Preferably the blade is vibrated parallel to the imaging surface and transversely of the direction in which the surface is moving relative to the blade.

In accordance with another embodiment in order to cure a cleaning failure, means are provided for vibrating the blade only after the moving imaging surface has stopped. In accordance with another embodiment of the invention, means are provided for vibrating the blade when the imaging surface is moving, and for a desired time interval after the imaging surface has come to a stop. In accordance with yet a further embodiment of this invention the blade is vibrated at a velocity greater than the velocity at which the surface of the imaging member is moving.

In accordance with this invention a process for removing residual particulate material from an electrostatic imaging surface is provided which includes the step of rapidly vibrating a cleaning blade which bears upon the imaging surface. In accordance with one embodiment, the vibrating step is carried out for a desired time interval after the imaging surface has stopped moving. Alternatively the vibration step can be carried out during movement of the imaging surface, and for a desired time inverval after it comes to a stop. In accordance with yet another embodiment, the blade is vibrated at a velocity greater than the velocity of the imaging surface.

An electrostatographic reproducing machine employing the above-noted apparatuses also forms a part of this invention.

It is accordingly an object of the present invention to provide a new and improved blade cleaning apparatus and electrostatographic reproducing machine.

It is another object of the present invention to provide a blade cleaning apparatus and process employing vibration for improved cleaning.

It is a further object of the present invention to provide a blade cleaning apparatus and process which substantially reduces the occurrence of "side-seal" cleaning failures.

It is still another object of the present invention to provide a vibratory blade cleaning apparatus and process wherein the blade may be selectively activated either during or after movement of the imaging surface.

Other objects and features of the present invention will become apparent by reference to the following description and drawings while the scope of the invention will be pointed out in the appended claims.

DETAILED DESCRIPTION

Figure 1:
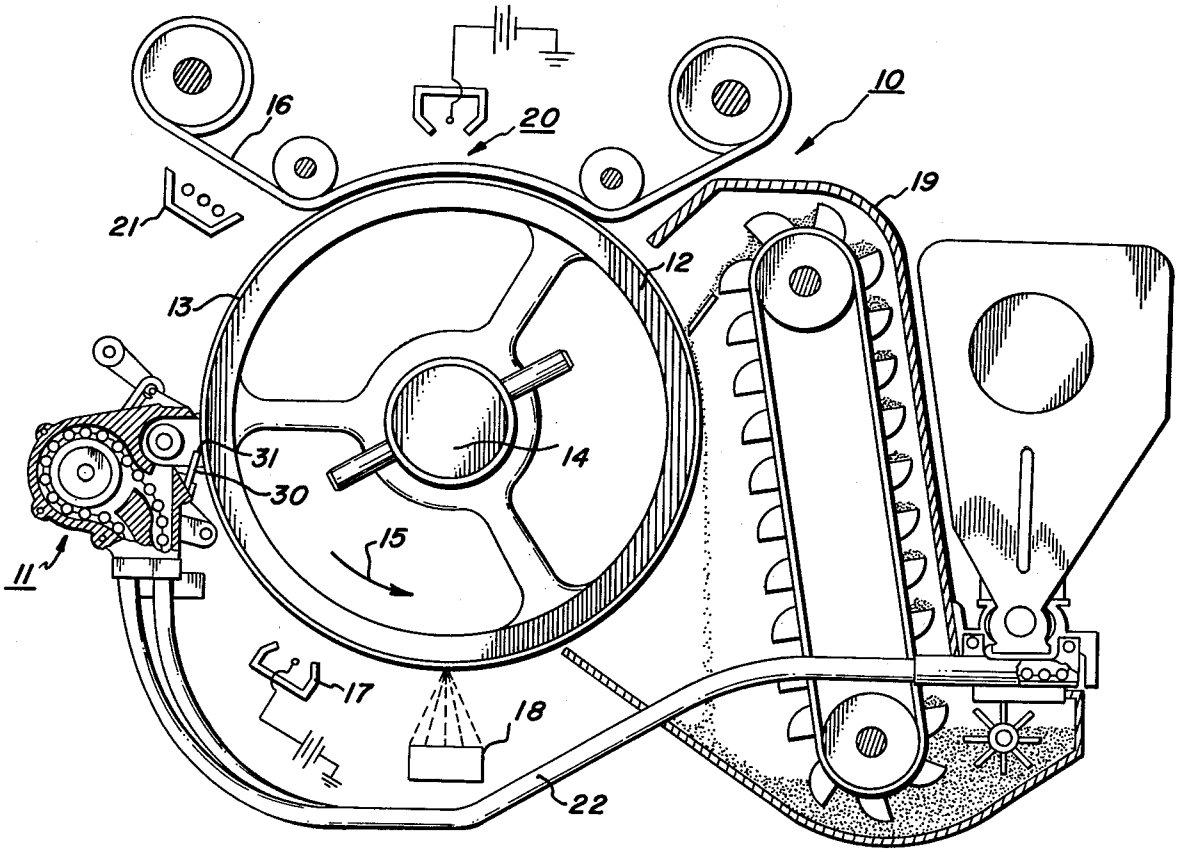
FIG. 1 illustrates a schematic representation of a reproducing machine and vibratory blade cleaning apparatus of the present invention.

Referring now to FIG. 1 there is shown by way of example an automatic xerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in their application to the particular embodiment or embodiments shown herein.

Figure 2:
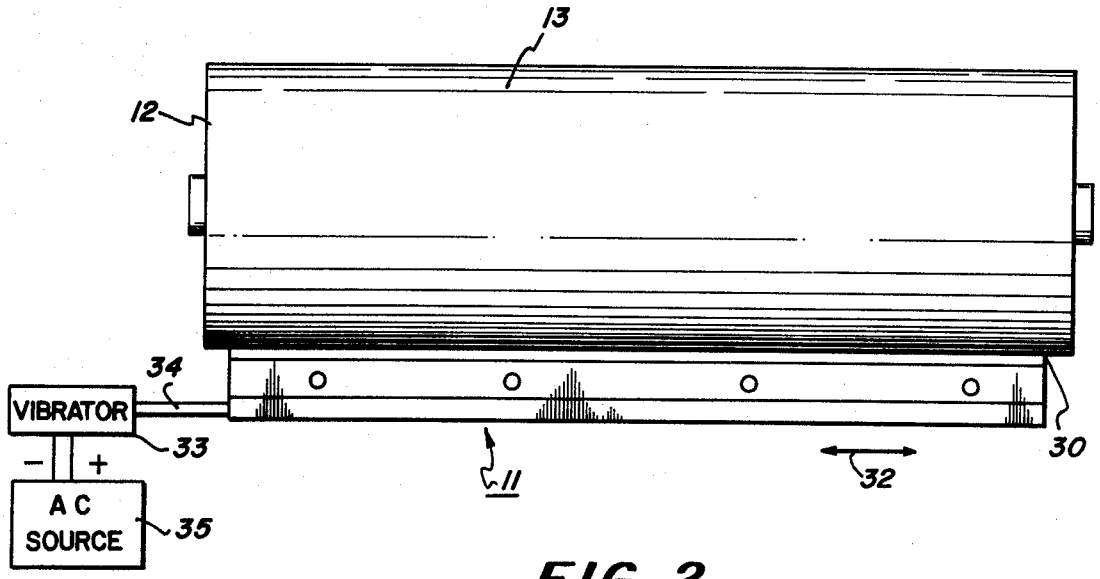
FIG. 2 is a top view of a vibratory blade cleaning apparatus of the present invention.

The reproducing machine 10 illustrated in FIG. 2 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a web or sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure, drum 12 rotates the electrostatic latent image recorded on the photoconductive surface 13 to development station 19 wherein a conventional developer mix including toner particles is cascaded over the photoconductive surface 13 rendering the latent image visible as a toner defined image.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16 the web with the image thereon is advanced to a suitable fuser 21 which coalesces the transferred powder image thereto. One type of suitable fuser is described in U.S. Pat. No. 2,701,765, issued to Codichini et al. in 1955. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are mechanically cleaned from the photoconductive surface 13 by the use of a vibrating blade as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The drum cleaning station 11 is positioned downstream from the transfer station 20 and upstream of the charging station 17. If desired, the removed toner can be returned for reuse to the developer station 19 by a suitable conveyor system 22.

Referring now to FIGS. 1 and 2, the elements of the cleaning apparatus 11 of the present invention are illustrated. The cleaning apparatus includes a relatively soft flexible cleaning blade 30. The blade 30 is adapted to rapidly vibrate back and forth across the drum surface 13 with an edge 31 of the blade in riding engagement against the drum surface. The normal imaging or working width of the drum surface 13 is somewhat less than the overall width of the drum 12. Therefore, the effective length of the blade 30 is preferably equal to the working width of the drum plus an amount in excess of the stroke of the blade movement which will assure effective cleaning of the entire working width of the drum 12 as well as the removal of impacted toner due to the developer housing end seals (not shown).

The blade may be comprised of any suitable flexible material, for example, polyurethane. Preferably the blade material should be relatively soft to prevent or minimize abrasion, scouring, scratching, etc., of the photoconductive surface, and yet allow effective cleaning of the surface. Suitable materials include polysiloxane rubber, polyurethane foam or rubber, polytetrafluoroethylene resin, polytrifluorochloroethylene resin, styrene butadiene rubber, nibile-silicone rubber, polyethylene resin and blends, mixtures and copolymers thereof.

The blade 30 is mounted for reciprocating movement in the directions shown by arrow 32. A vibrator 33 is suitably connected by rod 34 to the blade to rapidly vibrate it in the directions of arrow 32. A suitable vibrator is a VB-6C "Vibroblock" manufactured by Arthur G. Russell Co., Inc., Bristol, Conn., which unit operates at a line frequency of 60 hertz to supply a 60 cycle per second vibration in the longitudinal direction of the blade. The vibrator 33 is excited by an appropriate A.C. voltage source 35. Other types of vibratory devices 33 could be employed such as air or fluid actuated types.

The vibratory motion of the blade 30 is generally parallel to the imaging surface drum axis and transverse, and preferably normal to the general direction in which the imaging surface is moved past the blade. It is not intended that the vibratory action of the blade 30 include a normal component toward and away from the drum surface, although it is possible that such a component or vibration might be inherent in the arrangement described herein. The vibratory movement of the blade edge 31 toward and away from the imaging surface 13 is thought to be undesirable because toner particles have a very small size, on the order of 20 microns and, therefore, they might get past the blade without being removed. In addition, the particulate seal at the blade edge would be destroyed and thereby affect the cleaning action. It is preferred in accordance with this invention that the blade be maintained continuously in engagement with the imaging surface 13 during cleaning.

The blade 30 thus far described is a flexible elastomeric blade similar to that employed in the above-noted commercially available copiers. As a result, the blade itself limits the upper range of vibrational frequencies which can be employed. The higher the vibrational frequency, the greater will be the damping effect of this type of blade. At high frequencies the vibrations could be fully damped out before reaching the blade edge. A vibrational frequency of 60 cps has been successfully employed with a flexible polyurethane blade. Peak-to-peak vibrational amplitudes or strokes of from about 0.005 to about 0.012 inches has also been successfully tested although greater strokes are believed to be useful.

Rapid vibration is intended to clearly distinguish the blade oscillation of this invention from the relatively slow oscillations of the Shanley and Till patents noted above.

If one desired to employ higher frequency vibrations, as in accordance with a preferred embodiment of this invention, or ultrasonic vibrations as in accordance with the invention embodied in U.S. Pat. No. 4,007,982, filed of even date herewith by Stange, it is necessary to utilize a blade structure which will not have as great a damping capacity as the conventional flexible cleaning blade 30. A suitable blade structure is described, for example, in U.S. Pat. Nos. 3,848,992, and 3,848,993, to Smith and Hasiotis, respectively. These patents describe composite elastomeric cleaning blades wherein the main blade portion is formed of a more rigid thin material such as steel shim stock. It is intended that these patents be incorporated by reference into this description so that further description of their blade structures need not be presented herein.

Figure 4:
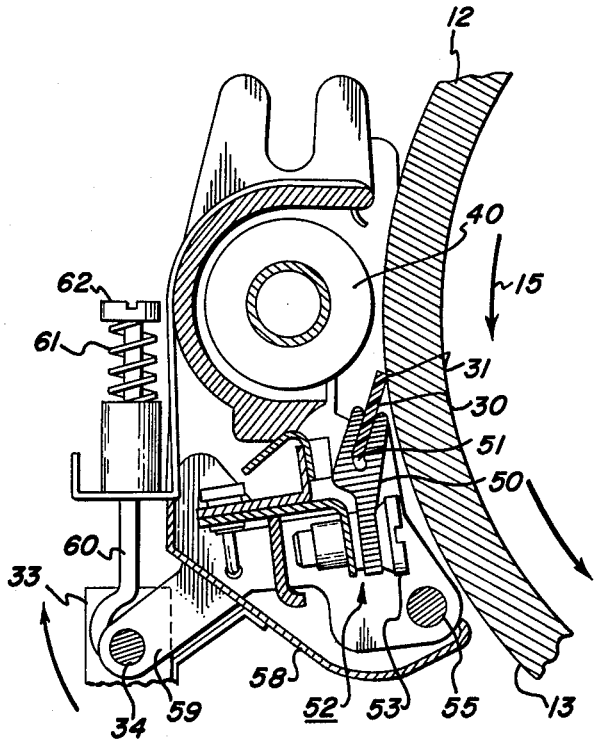
FIG. 4 is a side view of a vibratory blade cleaning apparatus of the present invention.
Figure 3:
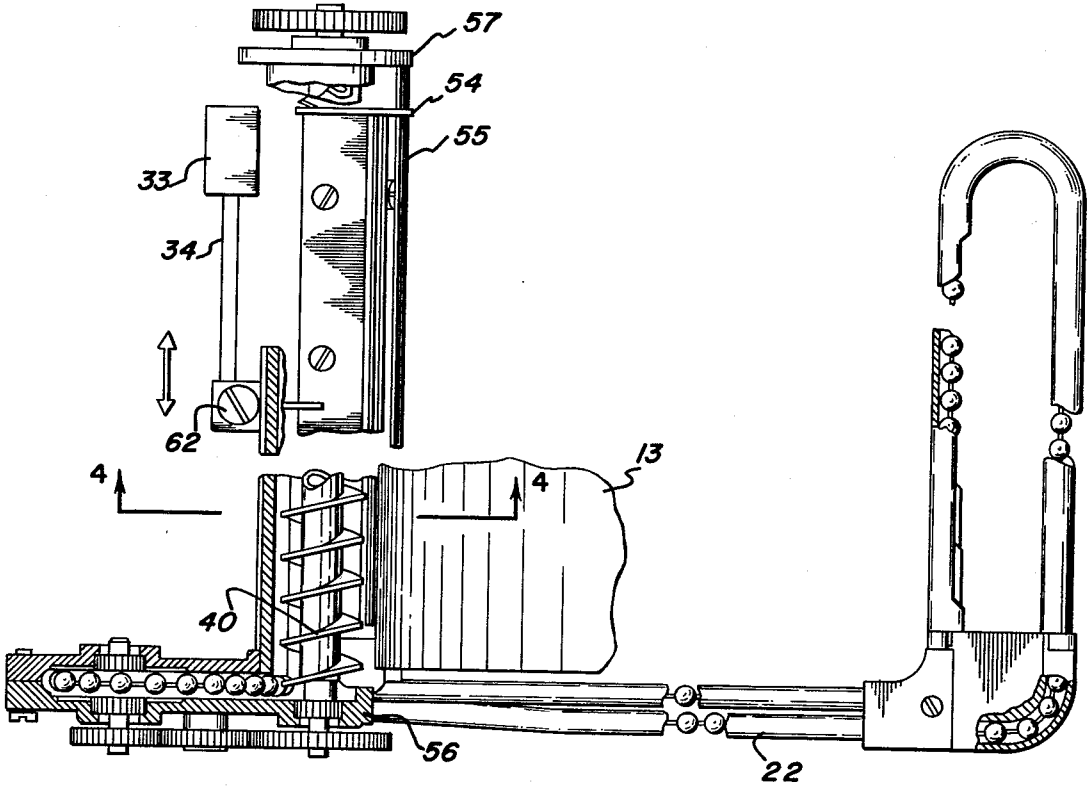
FIG. 3 is a top view of a vibratory blade cleaning apparatus of the present invention.

In order to test out the cleaning apparatus 11 of this invention the blade cleaning system of a Xerox 4000 copier cleaning system was modified by removing the translating motor and microswitch assemblies and replacing them with a VB-6C Vibroblock as shown in FIGS. 3 and 4. Details of the 4000 cleaning system can be obtained by reference to the machine itself or to the above-noted Shanley and Till patents.

Referring to FIGS. 3 and 4, the blade 30 is preferably positioned so that the cleaning edge 31 thereof extends toward the drum in a direction opposite to the direction in which the drum rotates so that the blade in effect chisels toner from the drum surface 13. The relative angle between the blade and plane of the tangent to the drum at the line of contact of the blade edge with the drum surface is selected for optimum cleaning or scraping effect.

The cleaning system to be described includes a toner reclaiming arrangement. The cleaning system of this invention need not include such an arrangement, and can be effectively utilized without toner recovery for reuse. To return residual toner removed from the drum 11 to the developer housing 19 there is provided a transfer auger 40. The auger 40 communicates with the toner removed by the blade 30 so as to transport the toner to the bead-chain conveyor 22 for transport back to the development system 19 for reuse.

The blade 30 is supported on a carriage 50 below and to one side of the auger 40. The carriage 50 has a longitudinally extending slot-like recess 57 therein for retaining the blade. The carriage 50 in turn is mounted on a movable support 52 with an adjustable mounting screw pair 53 being provided for this purpose. It being understood that the screw pair 53 permits the edge of the blade to be squared with the surface 13 of the drum 12.

The support 52 is in turn slidably and pivotally mounted through ends 54 thereof on a transversely extending shaft 55, carried by the end caps 56 and 57 of the toner recovery housing 58. The support 52 includes a rearwardly projecting drive arm 59 to which a bias link 60 is pinned. The opposite end of the link 60 is attached through a spring 61 to the toner recovery housing 58. Spring 61 serves to bias support 52 together with blade carriage 50 upwardly to hold the cleaning edge 31 of blade 30 in operative contact with the surface 13 of drum 12. A tension adjusting screw 62 is provided to enable the bias imposed by spring 61 to be regulated.

To vibrate the blade back and forth the Vibroblock is supported by the housing 58.

In this manner it was possible to test this invention in an operating environment.

In order to further illustrate the process and apparatus of the present invention the following examples are presented.

A Xerox 4000 copier which was modified as described with reference to FIGS. 3 and 4 was employed to carry out the test noted in the following examples.

EXAMPLE I

In this test a streak-type failure was allowed to form on the photoconductive surface of the copier. After it was formed the drum was stopped and the vibrator was excited momentarily to vibrate the blade. Following the vibration cycle, the machine was started again to see if the streak was eliminated. In the case of newly developed streaks, as little as 1 second of applied vibration was enough to cure the failure. For streaks that had been allowed to grow for several hundred copies, a period greater than the 1 second, but less than 10 seconds, was required to restore a clean surface. In this test a 0.005 inch peak-to-peak amplitude for the vibrations was utilized.

EXAMPLE II

In this test a streak-type failure was allowed to form on the photoconductive surface of the copier as in Example I. After the failure occurred, vibration was applied while the drum continued to rotate. The cleaning failures were cured within 10 to 20 copies. After the application of vibration, it was found that the amplitude of the vibrations required was somewhat higher than in Example I, namely, about 0.012 inches peak-to-peak at the blade edge.

EXAMPLE III

In this test, the copier was operated continuously without stopping the drum and the vibrator was left on during cleaning to see if a failure could be generated. In one test 500 copies were made with no streak-type failures, in another test light transient streaking occurred after 450 copies. This performance under the conditions noted was far better than the performance which would be expected in the absence of blade translation.

EXAMPLE IV

In this test the machine was operated as in Example III, except that the timing was changed so that the drum stopped for 1½ seconds between copies. In this test over a thousand copies were made without a streaking failure.

Examples I–IV indicate that vibration of the blade is effective to cure a streaking failure, and that the beneficial effects are most pronounced when the vibration is applied with the drum stopped. This is also true of the blade translation system of the Shanley and Till patents.

Other tests were performed which compared the vibrating blade cleaner of the present invention and the translating blade cleaner of the prior art. These tests established that the vibrating blade cleaning system was superior in preventing and curing developer "side seal" type cleaning failures.

The above description has shown the nature of the vibratory cleaning apparatus in detail. It should be realized that the vibration may desirably be selectively applied to the blade by appropriate means. The above examples indicate that for vibrational velocities less than the velocity of the surface the vibration is most effective in curing a cleaning problem which has developed from accumulated toner when the vibration is applied after the photoconductor surface 13 has stopped moving. In this condition, vibrations of short duration, e.g., up to about 20 seconds, and preferably from 1–20 seconds will completely eliminate many cleaning problems. For larger amplitudes of vibration, a shorter vibration interval may be used.

Figure 5:
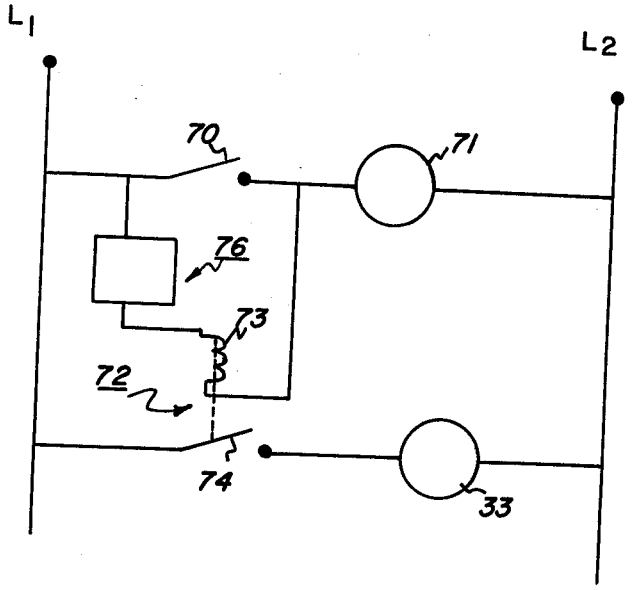
FIG. 5 is an electrical schematic circuit diagram for operating the vibratory mechanism of the present invention only after the imaging surface has stopped moving.

Based on the above considerations, a normally open time delay relay may be employed to excite the vibration means upon disappearance of photoconductor surface movement. Such a circuit arrangement is shown schematically in FIG. 5.

In that Figure $L_1$, $L_2$ represents the terminals of a primary and suitable source of electrical energy. A motor which is connected to $L_1$ $L_2$ through a control switch 70, operates to rotate the drum passed the various processing stations of the copy machine. In the arrangement shown, the motor 71 is operative with switch 70 in its closed position. When switch 70 is opened (i.e., the drum stops rotating), the energy of $L_1$ $L_2$ appears across relay coil 73 of time delay relay 72. Armature 74 of relay 72 is normally open, but closes upon energization of the relay coil. The closure of armature 74 provides energy from $L_1$ $L_2$ to vibration device 33 which is affixed to the blade 30 as previously described. Relay 72 is selected to be a time delay relay which deenergizes (or "drops out") after a specific time interval. The relay may, for example, be chosen to deenergize after 20 seconds of blade vibration.

Element 76 represents appropriate means which can be provided to activate the vibration system only after a predetermined time interval or after a pre-determined number of copies or some other chosen event.

Figure 6:
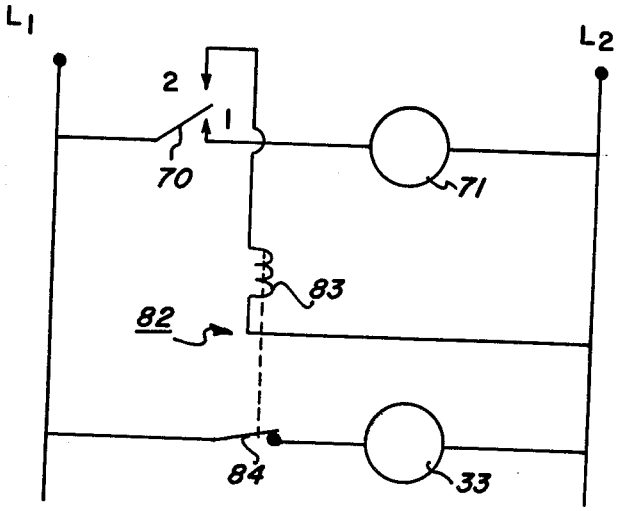
FIG. 6 is an alternative embodiment of an electrical schematic circuit diagram illustrating a controlling mechanism for allowing blade vibration during imaging surface movement and thereafter for a short interval.

An alternative arrangement is illustrated in FIG. 6. There, a design is shown which allows for vibration of the blade during drum rotation and afterwards for a short duration. Terminals $L_1$ $L_2$, motor 71, and vibrator 33 are as previously described. Control switch 70 is shown as a single pole, double throw switch. In position 1, the motor 71 is excited and time delay relay 82 is inactivated. The relay contact 84 of the relay is normally closed so that vibrating element 33 is also excited when the drum is rotating.

When control switch 70 is switched to position 2, the drum will stop rotating. Relay coil 83 of relay 82 is then energized which will cause contact 84 to open after a pre-determined time (e.g., 20 seconds).

Other systems of vibrator blade excitation will present themselves to those of ordinary skill. While frequencies in the order of 60 cycles have been suggested above, other frequencies, particularly higher frequencies are also within the scope of the present invention.

The use of vibrator excitations of non-sinusoidal waveshapes are similarly appropriate.

In the tests which were carried out as described above, the peak vibrational velocity of the blade edge was always less the drum surface 13 velocity. If the vibrational velocity of the blade edge were increased to a level greater than the velocity of the photoconductive surface, it might be possible to obtain the same curative and cleaning effects with the photoconductor moving as were achieved in the above-noted examples with the photoconductor stopped. Assume that the vibration of the blade is sinusoidal, the maximum vibration velocity of the blade edge, $V_{max}$, may be obtained from the following formula:

$$V_{max} = \pi (a) (f)$$

"$a$" is the peak-to-peak amplitude of the vibrations, "$f$" is the frequency of vibration, and $\pi$ is the constant 3.1415. . . The general relationship that $V_{max}$ is proportional to the product of the amplitude and frequency will hold with any type of vibration, sinusoidal or otherwise. It is believed that improved cleaning during blade vibration can be obtained by increasing $V_{max}$ to an amount greater than the drum peripheral velocity. Therefore, in accordance with a preferred embodiment of the present invention, it is proposed that the amplitude and frequency of the blade edge vibrations be selected to provide a vibrational velocity for the blade edge which is greater than the velocity of the photoconductor surface. The amplitude of the vibration should never be less than the width of a toner particle, and preferably should be as large as possible. Part of the difficulty in obtaining large amplitudes with a resilient flexible blade as used herein is due to the resiliency of the blade. The use of a composite blade as described in the Smith and Hasiotis patents should allow for greater vibrational velocities by permitting larger amplitudes for the vibrations and the use of higher frequencies.

The amplitude of the vibrations may be controlled in accordance with this invention by any desired mans. In the above-noted examples it was controlled by adjusting the voltage to the Vibroblock.

The patents and texts referred to specifically in this application are intended to be incorporated by reference into the application.

It is apparent that there has been provided in accordance with this invention, a cleaning apparatus, process and reproducing apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A cleaning apparatus for removing particulate material from the surface of a movable electrostatic imaging member, said apparatus comprising:

means for removing said particles from said surface, said removing means comprising at least one blade member extending across said surface and having an edge engaging said surface;

means for providing relative movement between said blade member and said imaging surface; and means for rapidly vibrating said blade member in a direction substantially parallel to said surface and transverse to the direction in which said imaging surface is moved, said vibrating means including means for supporting said blade for reciprocal movement transversely of the direction in which said imaging surface is moved; an electrically powered vibrator; and means for operatively connecting said vibrator to said means for supporting said blade for reciprocal movement.

2. An apparatus as in claim 1, further including means for selectively activating said vibrating means for a predetermined interval after said imaging surface has come to a stop.

3. An apparatus as in claim 1, further including means for selectively activating said vibrating means during movement of said imaging surface and for a predetermined interval after said imaging surface has stopped.

4. An process as in claim 1, wherein said vibrating means provides a vibrational velocity at said blade edge which is greater than the surface velocity of said imaging surface.

5. An apparatus as in claim 1, wherein said vibration means provides an amplitude for the vibrations of said blade edge of at least about 0.005 inches.

6. An apparatus as in claim 2, wherein said predetermined interval is less than 20 seconds.

7. An apparatus as in claim 3, wherein said predetermined interval is less than 20 seconds.

8. An apparatus as in claim 1, wherein said vibrating means vibrates said blade at a frequency of at least 60 cycles per second.

9. In an electrostatographic reproducing apparatus including means for forming an image on a sheet of final support material, said imaging means including a movable imaging surface, said apparatus including means for removing particulate material from said surface, said removing means comprising at least one blade member extending across said surface and having an edge engaging said surface, the improvement wherein, means are provided for rapidly vibrating said blade member in a direction substantially parallel to said surface and transverse to the direction in which said imaging surface is moved, said vibrating means comprising: means for supporting said blade for reciprocal movement transversely of the direction in which said imaging surface is movable; an electrically powered vibrator; and means for operatively connecting said vibrator to said means for supporting said blade.

10. An apparatus as in claim 9, further including means for selectively activating said vibrating means for a predetermined interval after said imaging surface has come to a stop.

11. An apparatus as in claim 9, further including means for selectively activating said vibrating means during movement of said imaging surface and for a predetermined interval after said imaging surface has stopped.

12. An apparatus as in claim 9, wherein said vibrating means provides a vibrational velocity at said blade edge which is greater than the surface velocity of said imaging surface.

13. An apparatus as in claim 9, wherein said vibration means provides an amplitude for the vibrations of said blade edge of at least about 0.005 inches.

14. An apparatus as in claim 10, wherein said predetermined interval is less than 20 seconds.

15. An apparatus as in claim 11, wherein said predetermined interval is less than 20 seconds.

16. An apparatus as in claim 9, wherein said vibrating means vibrates said blade at a frequency of at least 60 cycles per second.

17. An apparatus as in claim 9, further including means for forming an image on said imaging surface, means for developing the image on said surface to render it visible, and means for transferring said visible image from said imaging surface to said sheet of support material.

18. The cleaning process for removing particulate material from the surface of a moving electrostatic imaging member comprising:

engaging said imaging surface with an edge of a blade cleaning member; and rapidly vibrating said blade member in a direction substantially parallel to said surface and transverse to the direction in which said surface is moved, said vibration providing a vibrational velocity at said blade edge which is greater than the surface velocity at said imaging surface.

19. A process as in claim 18, further including the step of moving said imaging surface past said blade for a predetermined period.

20. A process as in claim 19, wherein said vibration is selectively applied during a predetermined interval after said imaging surface has come to a stop.

21. An apparatus as in claim 19, wherein said vibration is selectively applied during movement of said imaging surface past said blade member, and for a predetermined interval after said imaging surface has come to a stop.

22. A process as in claim 18, wherein the amplitude of said vibrations in said vibration step comprises at least 0.005 inches.

23. A process as in claim 20, wherein said predetermined interval is less than 20 seconds.

24. A process as in claim 21, wherein said predetermined interval is less than 20 seconds.

25. A process as in claim 18, wherein said blade is vibrated at a frequency of at least 60 cycles per second.

26. A process as in claim 18, wherein prior to said cleaning the following steps are performed, forming a latent electrostatic image on said surface, developing said electrostatic image to render it visible, and transferring said visible image to a sheet of final support material.

27. A cleaning apparatus for removing particulate material from the surface of a movable electrostatic imaging member, said apparatus comprising:

means for removing said particles from said surface comprising at least one blade member extending across said surface and having an edge engaging said surface;

means for providing relative movement between said blade member and said imaging surface; and means for rapidly vibrating said blade member in a direction substantially parallel to said surface and transverse to the direction in which said imaging surface is moved, said vibrating means providing a vibrational velocity at said blade edge which is greater than the surface velocity of said imaging surface.

28. An an electrostatographic reproducing apparatus including means for forming an image on a sheet of final support material, said imaging means including a movable imaging surface, said apparatus including means for removing particulate material from said imaging surface, said removing means comprising at least one blade member extending across said surface and having an edge engaging said surface, the improvement wherein, means are provided for rapidly vibrating said blade member in a direction substantially parallel to said surface and transverse to the direction in which said surface is moved, said vibrating means providing a vibrational velocity at said blade edge which is greater than the surface velocity of said imaging surface.

* * * * *